US007995785B2

(12) United States Patent
Royse

(10) Patent No.: US 7,995,785 B2
(45) Date of Patent: Aug. 9, 2011

(54) SPEAKER ASSEMBLY WITH MOUNTING PLATE

(75) Inventor: Eric Royse, Indianapolis, IN (US)

(73) Assignee: Harman International Industries, Incorporated, Northridge, CA (US)

( * ) Notice: Subject to any disclaimer, the term of this patent is extended or adjusted under 35 U.S.C. 154(b) by 1346 days.

(21) Appl. No.: 11/541,980

(22) Filed: Oct. 2, 2006

(65) Prior Publication Data

US 2007/0230738 A1 Oct. 4, 2007

Related U.S. Application Data

(60) Provisional application No. 60/786,634, filed on Mar. 28, 2006.

(51) Int. Cl.
*H04R 1/00* (2006.01)
*H04R 1/02* (2006.01)

(52) U.S. Cl. ..... 381/386; 381/395; 381/396

(58) Field of Classification Search ..... 381/386, 381/395, 396, 398, 400, 412; 181/148, 157
See application file for complete search history.

(56) References Cited

U.S. PATENT DOCUMENTS

| | | | | |
|---|---|---|---|---|
| 2002/0008602 | A1* | 1/2002 | Kyouno et al. | 335/220 |
| 2003/0075381 | A1* | 4/2003 | Abdo | 181/148 |
| 2005/0041831 | A1* | 2/2005 | Stiles et al. | 381/412 |
| 2007/0127765 | A1* | 6/2007 | Chan | 381/396 |

* cited by examiner

*Primary Examiner* — Tuan D Nguyen

(57) ABSTRACT

A speaker assembly may include a speaker basket, a mounting plate, and a shell pot. The speaker basket may be a plastic speaker basket. The mounting plate may be insert molded into the speaker basket. The shell pot may be seated into an opening in the mounting plate and coupled to the mounting plate. Further, the shell pot may be configured to house additional speaker components, such as a motor assembly.

21 Claims, 7 Drawing Sheets

SPEAKER ASSEMBLY WITH MOUNTING PLATE

CROSS REFERENCE TO RELATED APPLICATIONS

This application claims the benefit of U.S. provisional application 60/786,634 filed on Mar. 28, 2006, the contents of which are incorporated by reference.

BACKGROUND OF THE INVENTION

1. Technical Field

The invention generally relates to a speaker assembly. More specifically, the invention relates to a speaker assembly with a mounting plate for attaching a pot shell to a speaker basket.

2. Related Art

Plastic speaker baskets have been available in industry for a number of years. Plastic speaker baskets may be used to reduce weight and provide a low cost structure for certain speaker applications. Accordingly, plastic speaker baskets have often been used in automotive applications. In the past, plastic speaker baskets have generally been molded directly over a speaker shell pot. The rest of the speaker components are then assembled with relation to the shell pot. However, the shell pot geometry often changes based on the design of the speaker assembly. Accordingly new tooling, such as a new mold or mold detail, must be produced for each shell pot design, as well as, each set of production tooling. Therefore, supporting multiple speaker designs can significantly increase manufacturing cost and complexity.

Some designs have contemplated attaching the shell pot directly to the plastic basket using either a twist lock design and/or using an adhesive to bond the shell pot to the plastic speaker basket. Although such designs allowed the attachment of any of multiple shell pots to a common plastic basket, these designs may have insufficient durability for some applications. Further, a twisting or locking detail may lead to increased tooling complexity and manufacturing issues. Therefore, a need exists for an improved speaker assembly.

SUMMARY

This invention provides an improved speaker assembly. The speaker assembly includes a speaker basket, a mounting plate, and a shell pot. The speaker basket may be a plastic speaker basket, such that the mounting plate may be insert molded into the speaker basket. The shell pot may be configured to receive and house additional speaker components, such as one or more speaker motors. The mounting plate may be a metal ring, for example a steel ring with a zinc coating. The ring may include bores positioned about the circumference of the ring, such that plastic from the speaker basket may flow through the bores as the ring is insert molded into the speaker basket. To fix the shell pot to the mounting plate, the shell pot may include an upper flange that engages the top of the mounting plate, and a lower flange that engages the bottom of the mounting plate. Accordingly, the upper or lower flange may be staked, thereby securing the shell pot to the mounting plate. By attaching the shell pot to the speaker basket through the mounting plate, a simple attachment interface can be defined that allows the use of multiple speaker motor designs with a single speaker basket, thereby reducing manufacturing complexity and cost of the speaker assembly.

Other systems, methods, features and advantages of the invention will be, or will become, apparent to one with skill in the art upon examination of the following Figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the Figures are not necessarily to scale, emphasis instead being placed upon illustrating the principles of the invention. Moreover, in the Figures, like referenced numerals designate corresponding parts throughout the different views.

DETAILED DESCRIPTION OF THE PREFERRED EMBODIMENTS

Figure 1:
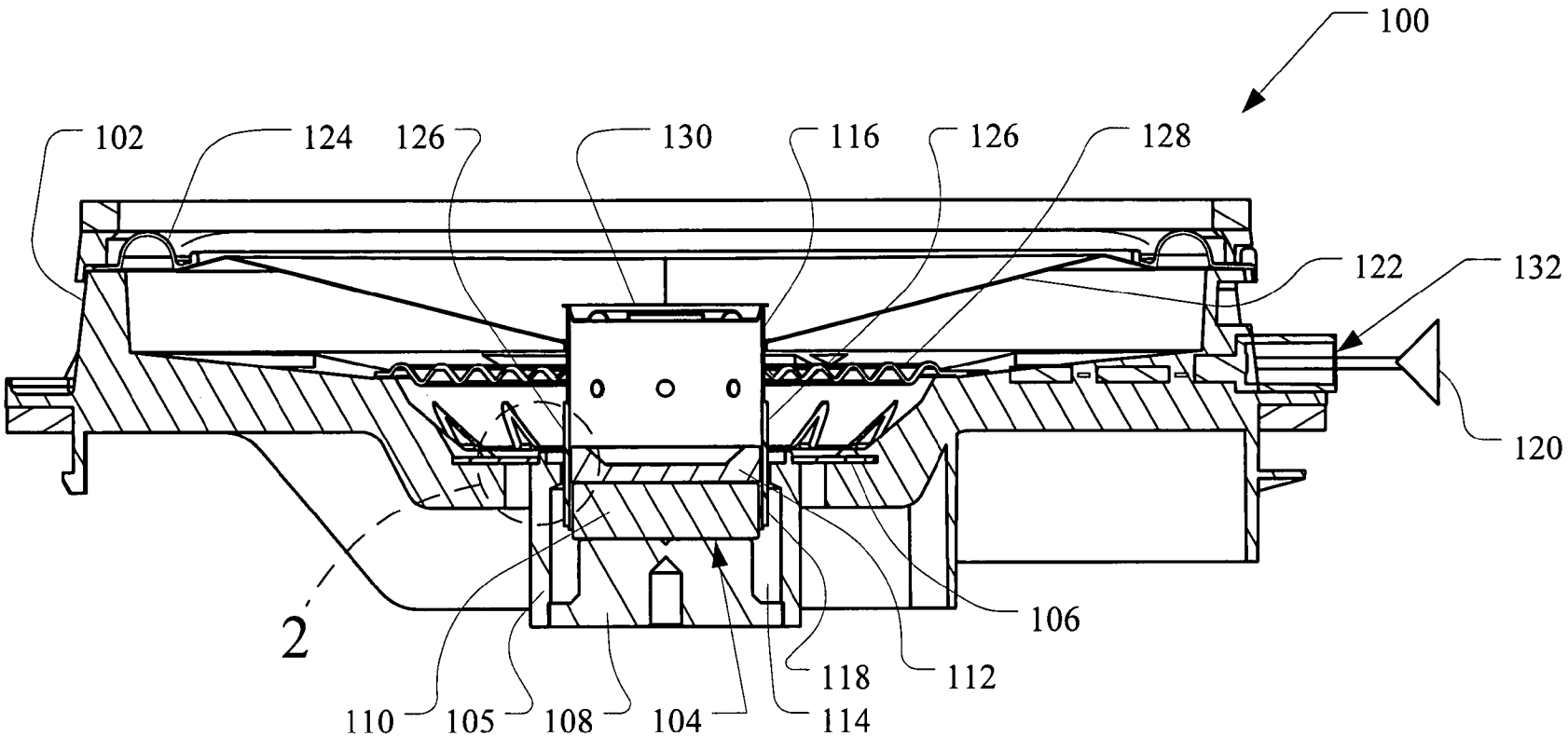
FIG. 1 is a sectional side view of a speaker assembly.

In FIG. 1, an example loudspeaker 100 is illustrated. The loudspeaker 100 may include a supporting speaker basket 102, a mounting plate 106, a shell pot 105, and a motor assembly 104. In other examples, multiple mounting plates 106, shell pots 105 and/or motor assemblies 104 may be included in the loudspeaker 100. The speaker basket 102 may include a lip that extends outwardly from a main portion of the speaker basket 102. The speaker basket 102 may be formed of a plastic material, for example a polycarbonate material or any other thermoplastic resin based material. The mounting plate 106 may be a metal disk or ring that may be insert molded into the plastic material or otherwise coupled with the speaker basket 102. The shell pot 105 may be a metal casting or other rigid material formed to house the motor assembly 104, and may be attached to the mounting plate 106. For example, the shell pot 105 may be seated into an opening in the mounting plate 106 and attached to the mounting plate 106 about the perimeter of the opening.

The motor assembly 104 may include a back plate or center pole 108, a permanent magnet 110, and a front or top plate 112 that may provide a substantially uniform magnetic field across an air gap 114. A voice coil former 116 may support a voice coil 118 in the magnetic field. Generally, during operation, current from an amplifier 120, or some other device supplying electric signals representing program material to be transduced by the loudspeaker 100 may drive the voice coil 118. The voice coil 118 may reciprocate axially in the air gap 114. Reciprocation of the voice coil 118 in the air gap 114 generates sound representing the program material transduced by the loudspeaker 100.

The loudspeaker 100 may also include a cone 122. A portion of the cone 122 may be coupled with an end of the voice coil former 116. An outer end of the cone 122 may be coupled to a surround or compliance 124. The surround 124 may be coupled at an outer perimeter to the basket 102. In other examples, the cone 122 may be coupled with the voice coil former 116 via the spider 128 or any other component of the loudspeaker 100. In addition, or alternatively, the cone 112 may be coupled with the speaker basket 102 directly, or via any other component. As described previously, the basket 102 may also include the lip that may be used to support mounting of the loudspeaker 100 in a desired location such as a surface or in a loudspeaker enclosure.

A spider 128 may be coupled at an outer perimeter of the spider 128 to the basket 102. The spider 128 may include a central opening 126 to which the voice coil former 116 is coupled. A suspension that may include the surround 124 and the spider 128 may constrain the voice coil 118 to reciprocate axially in the air gap 114. In addition, the loudspeaker 100 may include a center cap or dust dome 130 that is designed to keep dust or other particulars out of the motor assembly 104.

The loudspeaker 100 may include a pair of loudspeaker terminals 132. The loudspeaker terminals 132 may provide a positive and negative terminal for the loudspeaker 100. Voice coil wires may connect the loudspeaker terminals 132 to the voice coil 118. The amplifier 120 may be in electrical communication with the voice coil 118 through the loudspeaker terminals 132.

The loudspeaker 100 in FIG. 1 is illustrated with the basket 102, the cone 122, and the surround 124 formed in a generally oval shape. Different geometric loudspeaker shapes may also be used, such as loudspeakers formed in the shape of squares, circles, rectangles and so forth. In addition, the components that are used to form the loudspeaker 100 set forth above should be viewed in an illustrative sense and not as a limitation. Other components may alternatively or in addition be included in the loudspeaker 100.

Figure 2:
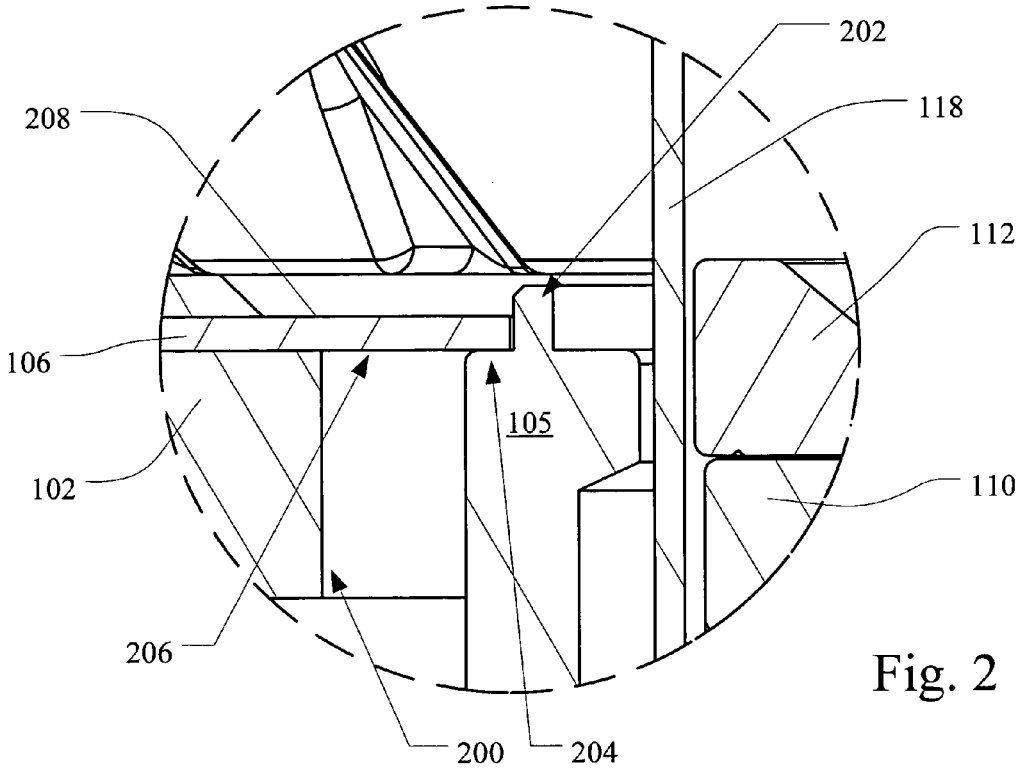
FIG. 2 is an enlarged sectional side view of the speaker assembly as denoted by reference numeral 2 in FIG. 1.

In FIG. 2, an enlarged view of the loudspeaker 100 is provided as denoted by reference numeral 2 in FIG. 1. The mounting plate 106 is molded into the plastic material of the speaker basket 102. As such, the mounting plate 106 may be partially or completely embedded in the speaker basket 102, and extend into an opening 200 formed in the speaker basket 102. The shell pot 105 may be received into the opening 200 and may be coupled with the mounting plate 106 to be concentric with the speaker basket 102. The shell pot 105 may be affixed to the mounting plate 106 using conventional attachment methods including staking, welding, soldering, adhesives, or by using fasteners, such as screws, rivets, or any other fasteners. The shell pot 105 may include a first flange 202 and a second flange 204 that are an upper flange and a lower flange respectively. The first flange 204 may engage or be positioned adjacent a first surface 206 of the mounting plate 106 that is a bottom surface in FIG. 2. The second flange 202 may be staked such that the upper flange 202 engages or is positioned adjacent a second surface 208 of the mounting plate 106 that is opposite the first surface 206. The shell pot 105 may be configured to receive and house speaker components including, for example, the voice coil 118, the top plate 112, the permanent magnet 110, or other speaker components.

Figure 3:
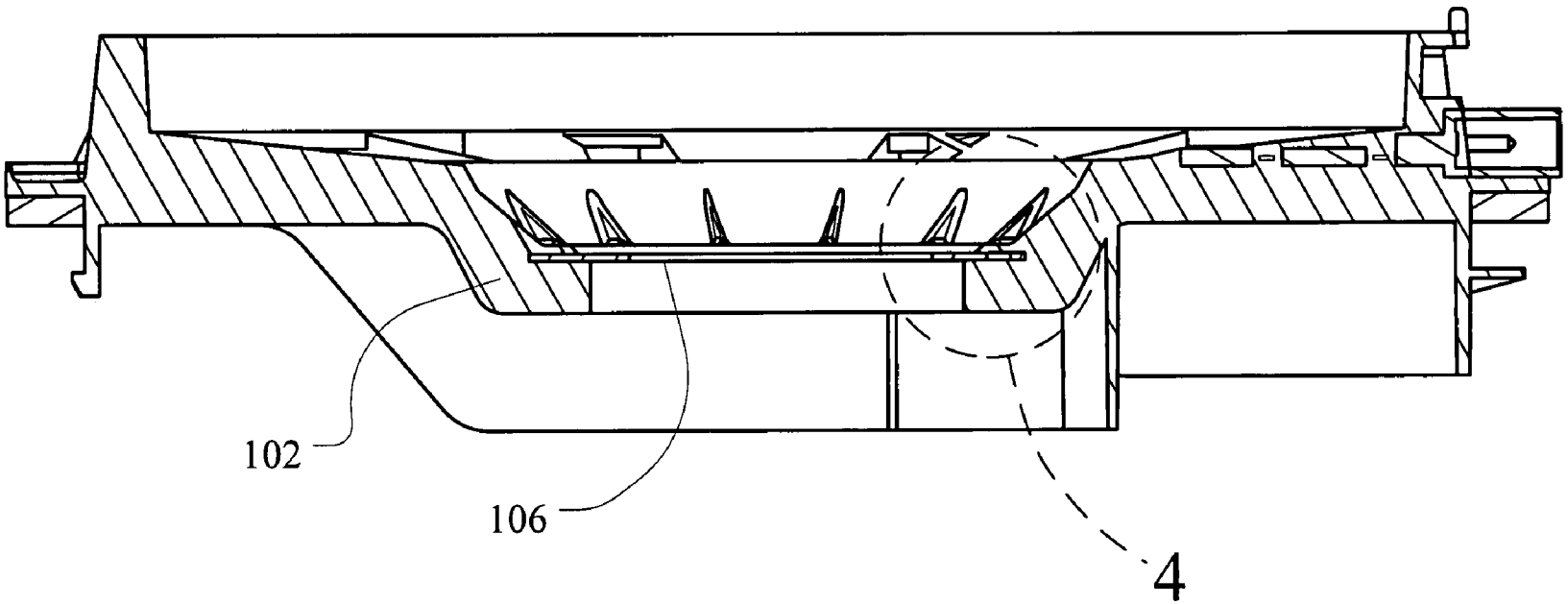
FIG. 3 is a sectional side view of the speaker basket and mounting plate.

In FIG. 3, a sectional side view of the speaker basket 102 and the mounting plate 106 is provided absent the shell pot 105. The speaker basket 102 may be one or more molded plastic components such that the speaker basket 102 is formed around at least a portion of the mounting plate 106, for example by an insert injection molding process. The speaker basket 102 may include an opening 200 configured to receive the shell pot 105 and other speaker components. The mounting plate 106 may extend into the opening 200 allowing the shell pot 105 to be securely coupled to the mounting plate 106. Accordingly, the shell pot 105 may be attached to the speaker basket 102 through the mounting plate 106.

Figure 4:
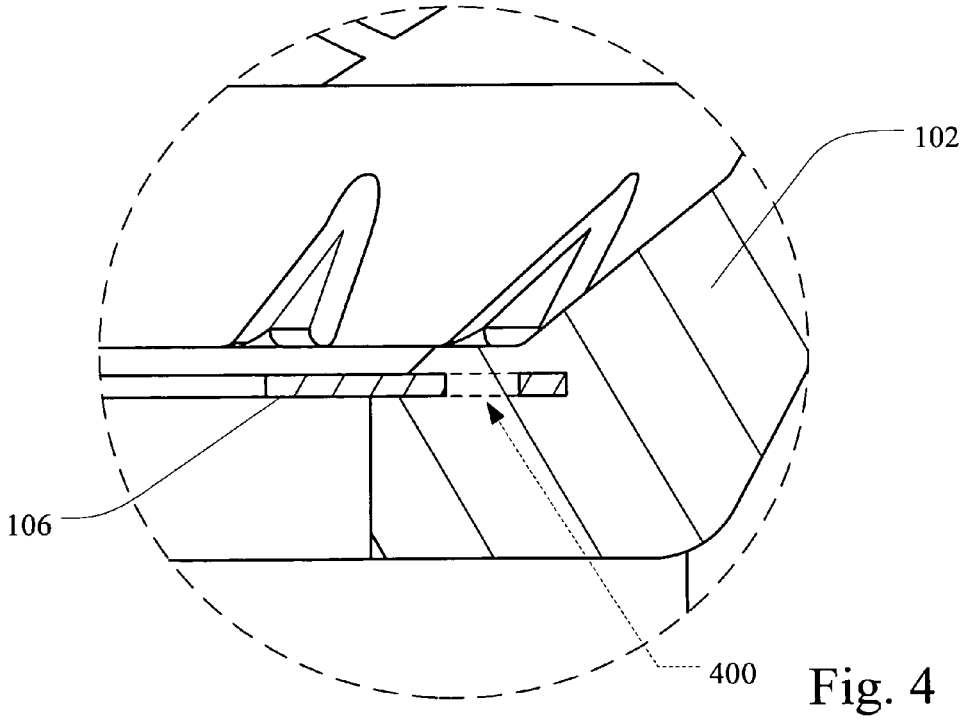
FIG. 4 is an enlarged sectional side view of the speaker basket and mounting plate as denoted by reference numeral 4 in FIG. 3.

In FIG. 4, an enlarged sectional side view of the speaker basket 102 is provided as denoted by reference numeral 4 in FIG. 3. The mounting plate 106 may be formed to include bores 400. The bores 400 may be located about the perimeter of mounting plate 106. Portions of the speaker basket, such as fingers may extend through the bores 400. Where the speaker basket 102 is a plastic molded component, the plastic from the speaker basket 102 may continuously extend through the bores 400 and engage the mounting plate 106. Accordingly, the portion of the mounting plate 106 including the bores 400 may be embedded within or integrally formed with, the speaker basket 102 and the portions of the speaker basket 102 that extend through the bores 400 may provide additional in plane stability, minimizing and/or preventing shifting or rotation of the mounting plate 106.

Figure 5:
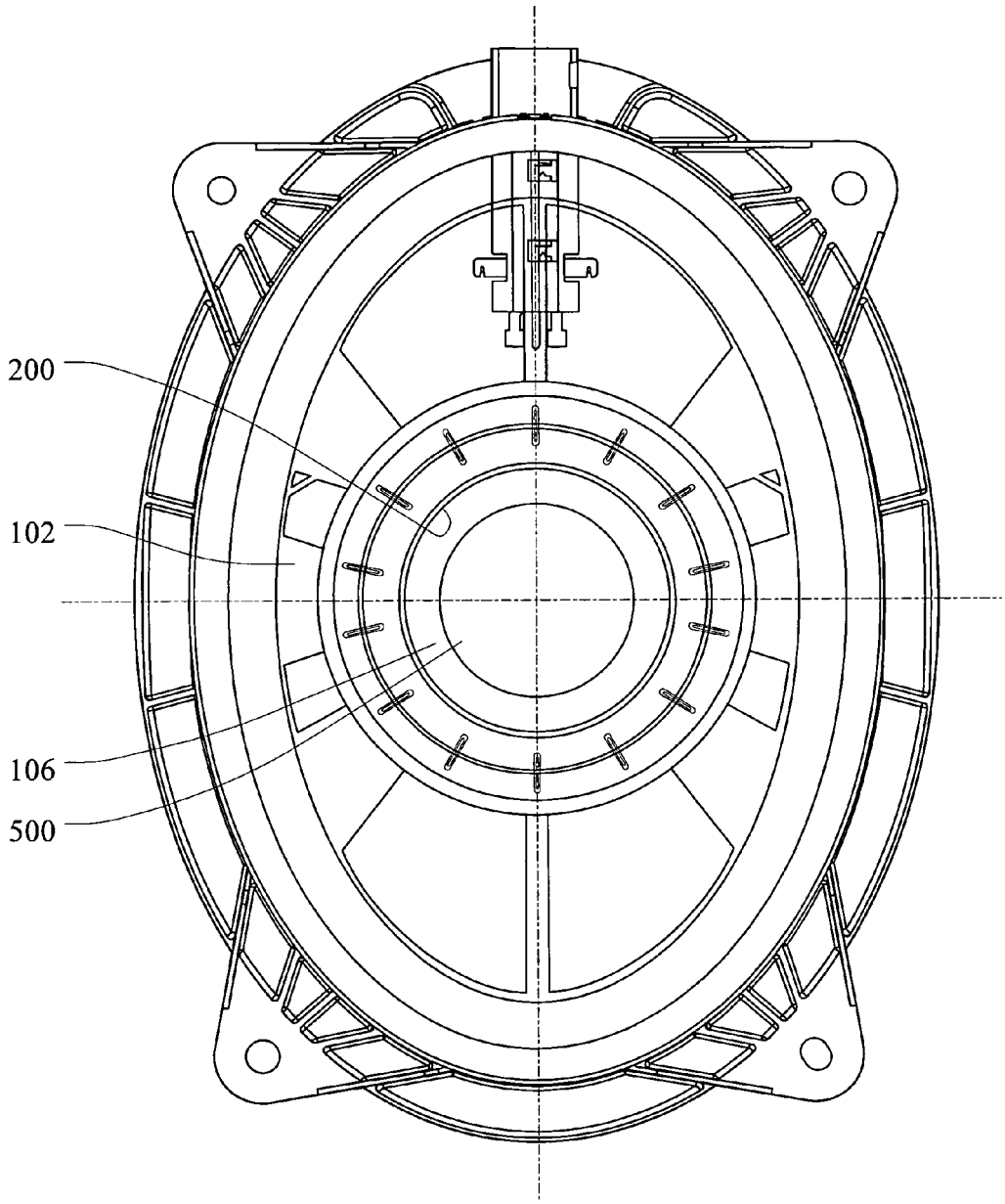
FIG. 5 is a plan view of the speaker basket and mounting plate shown in FIG. 3.

In FIG. 5, a plan view is provided of the speaker basket 102 and mounting plate 106 prior to insertion of the shell pot 105. The mounting plate 106, may be a disk that can be seen extending into the opening 200 of the speaker basket 102. Further, the mounting plate 106 may form a ring including a mounting plate opening 500 that is configured to receive the shell pot 105. The shell pot 105 may be fixed to the mounting plate 106 along the outer periphery of the shell pot 105. The portion of the mounting plate 106 that openly extends into the basket opening 200 may be used as a surface for mounting the shell pot 105 to the mounting plate 106. Accordingly, the shell pot 105 may be staked, welded, soldered or otherwise bonded to the open surface of the mounting plate 106. In addition, bores (not shown) may be provided through the open surface of the mounting plate 106, thereby allowing the use of fasteners to attach the shell pot 105 to the mounting plate 106. Alternatively, it is clear that other motor structures, for example ring shaped magnet motor structures including ceramic motor structures may be readily attached using this method. Bolts, rivets, or other fasteners may be used to attach the shell pot 105 to the mounting plate 106. In addition, the bores (not shown) may be threaded allowing the shell pot 105 to be bolted directly into the mounting plate 106. In another example, the mounting plate 106 may be substantially completely embedded in the speaker basket 102 and the shell pot 105 may be coupled with an inner edge of the mounting plate 106 and/or coupled with the mounting plate 106 through the speaker basket 102.

Figure 6:
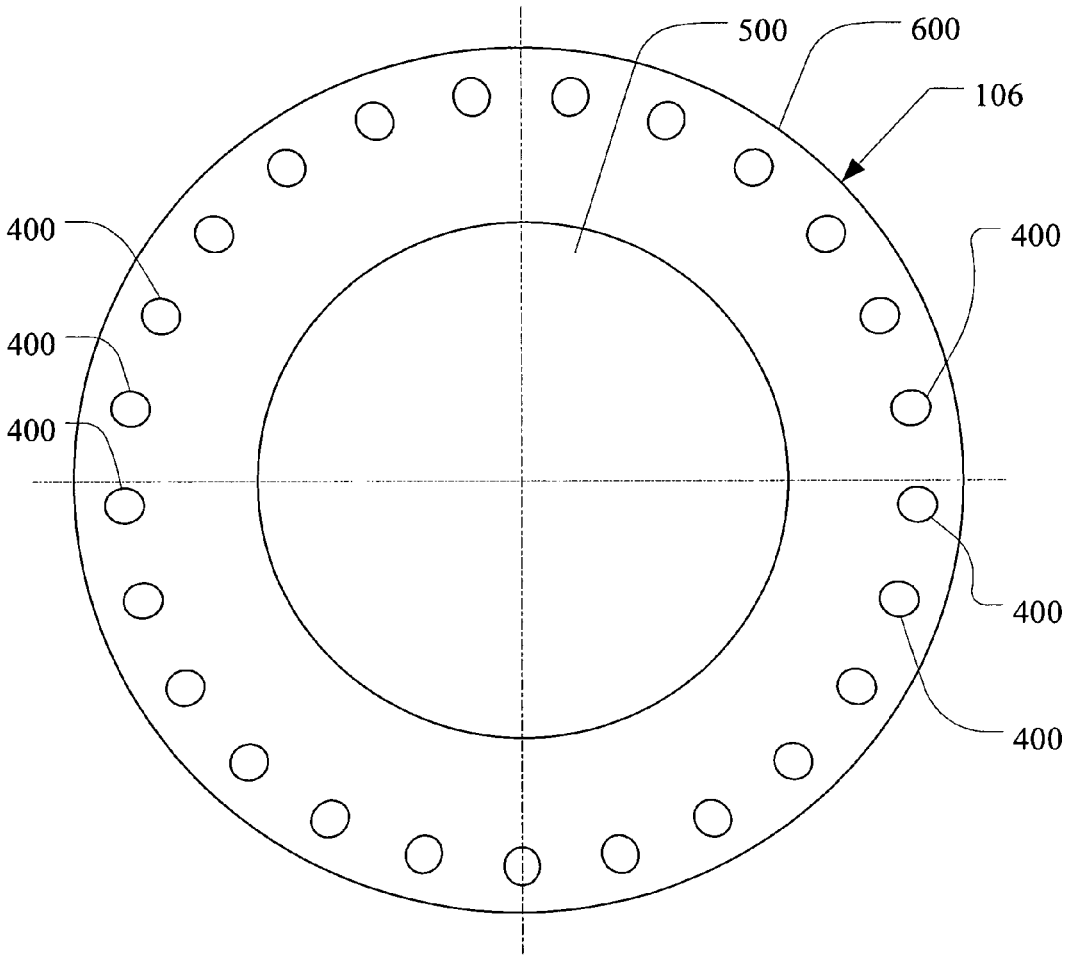
FIG. 6 is a plan view of a mounting plate.

In FIG. 6, an example of the mounting plate 106 is shown as a ring where the outer perimeter 600 of the mounting plate 106 is circular. The mounting plate opening 500 may also be circular and concentric with the outer perimeter 600 of the mounting plate 106. Although, other shapes may be used for the mounting plate 106 and mounting plate opening 500 including but not limited to squares, rectangles, or ovals. The mounting plate 106 includes bores 400 that may be periodically and circumferentially spaced adjacent the outer edge of the mounting plate 106 and/or concentric with the opening. It is further understood that the bores 400 may be located anywhere on the mounting plate 106 and may be uniformly or non-uniformly spaced. The mounting plate 106 may be made of metal or any other rigid material with a melting point greater than the material of the speaker basket 102, allowing it to be insert molded into the speaker basket 102. To provide stability and corrosion protection, the mounting plate 106 may be made of steel and may have a thickness greater than about 1 mm, for example, an 18 American wire gauge (AWG) steel with a zinc coating. As such, the mounting plate may be sufficiently stabilized within the speaker basket 102 and may provide sufficient support to the shell pot 105 and the motor assembly 104 to ensure desired performance by the loudspeaker 100. Other materials, coatings, and thicknesses may be used to form the mounting plate 106 depending on the particular speaker application.

Figure 8:
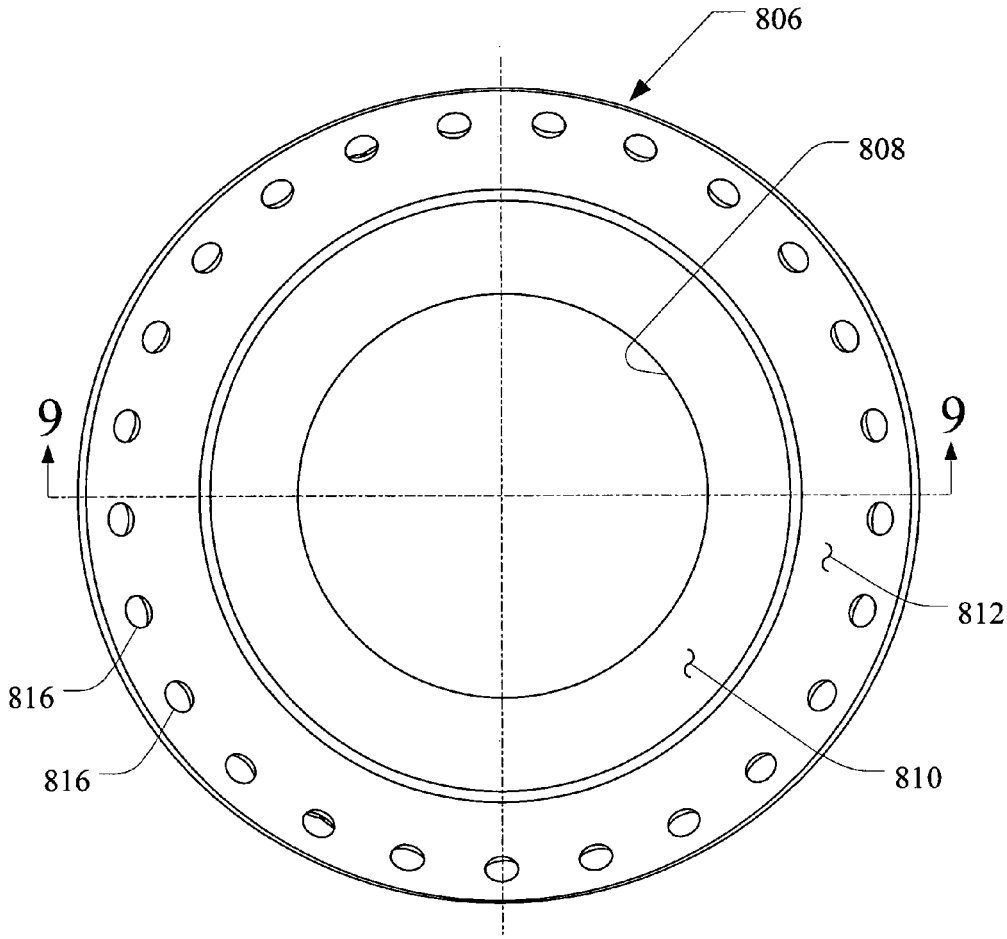
FIG. 8 is a sectional side view of a mounting plate having an angled portion.
Figure 9:
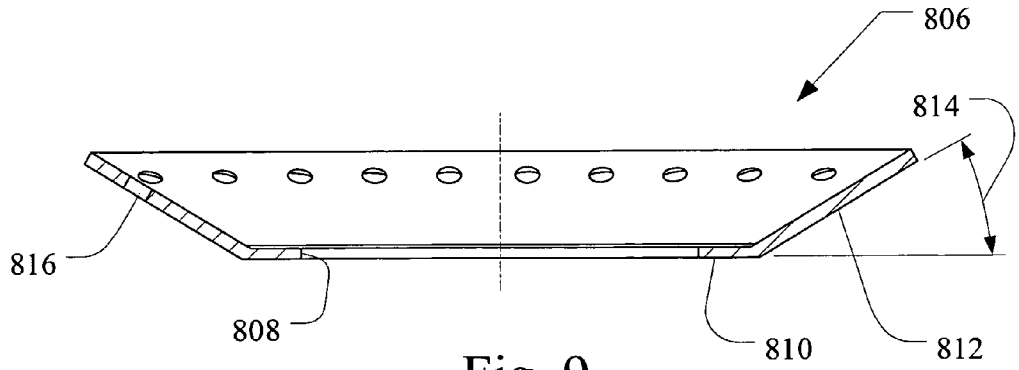
FIG. 9 is a plan view of the mounting plate shown in FIG. 8.

In FIG. 8, another example of the mounting plate is denoted as reference numeral 806. The mounting plate 806 may include an opening 808 configured to receive the shell pot 105, and bores 816 allowing the speaker basket 102 to extend through and engage the mounting plate 806 as previously described. However, in this example, the mounting plate 806 may include a first portion 810 that is parallel with the opening 808 and a second portion 812 that is formed at an angle 814 in FIG. 9 relative to the first portion 810. In one example, the angle 814 may be between about 20° and 80°, for example about 45°. In FIGS. 8 and 9, the mounting plate 806 is circular. Accordingly, the second portion 812 may have a generally conical geometry. In other examples, the bores 816 may be located about the periphery of the second portion 812 and, therefore, may be embedded into the speaker basket 102 as previously described. Bores 816 may be anywhere. The angle 814 of the second portion 812 may allow for a larger portion of the mounting plate 806 to be embedded into the speaker basket 102 while minimizing the profile of the speaker assembly. In addition, having one or more angled portions may improve the stabilization of the mounting bracket 806 within the speaker basket 102. In another example, the mounting plate 806 may be substantially completely embedded in the speaker basket 102 such that the second portion 812 is completely embedded, and the first portion 810 is substantially completely embedded in the speaker basket 802.

Figure 7:
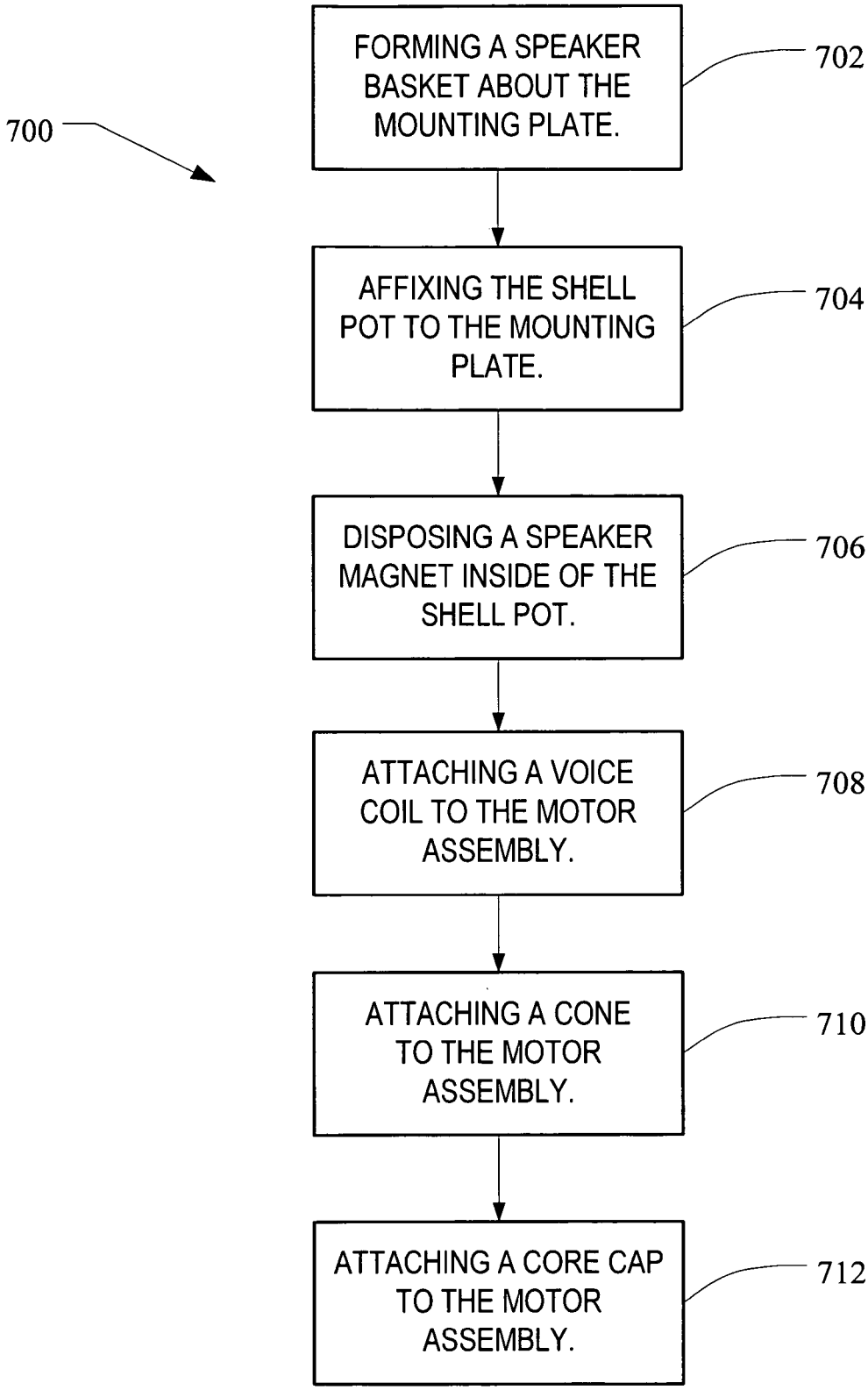
FIG. 7 is a flow chart illustrating a method for manufacturing a speaker.

In FIG. 7, an example method to manufacture a loudspeaker is provided with reference to FIGS. 1-6. In block 702, a speaker basket 102 is formed about at least a portion of a mounting plate 106. The speaker basket 102 may be formed from a plastic material, and molded about the mounting plate 106, for example by an insert injection molding process. Other formable materials also may be used to form the speaker basket 102. The mounting plate 106 may be positioned in the mold cavity prior to injecting the plastic that is formed into the speaker basket 102. The plastic may be flowed to at least partially enclose the mounting plate 106. Further, a portion of the mounting plate 106 is maintained outside of the plastic to receive the shell pot 105.

The mounting plate 106 may be provided with bores 400, such that the plastic forming the speaker basket 102 may flow through the bores 400 of the mounting plate 106. As the plastic cools, portions of the speaker basket 102 may form columns that extend through the bores 400 and engage the mounting plate 106 providing additional in plane support for the mounting plate 106 to minimize and/or prevent translation or rotation of the mounting plate 106 relative to the speaker basket 102.

In block 704, the shell pot 105 is affixed to the mounting plate 106. The shell pot 105 may be affixed to the mounting plate 106 using attachment means, including staking, fastening, and bonding. In one example, the shell pot 105 may be provided with a first flange 202 and second flange 204. The first and second flange 202 and 204 may engage a surface of the mounting plate 106, thereby affixing the shell pot 105 to the mounting plate 106. For example, the shell pot 105 may be received within an opening 500 of the mounting plate 106 such that at least one of the flanges engages a surface of the mounting plate 106. The other flange may then be staked against the opposite surface of the mounting plate 106, thereby affixing the shell pot 105 to the mounting plate 106.

The motor assembly 104 may then be built. In block 706, a permanent magnet 110 may be received within, and attached inside of the shell pot 105. The magnet 110 may, for example, be glued inside of the shell pot 105. In block 708, a voice coil 118 may be received by the shell pot 105. The voice coil 118 may be disposed in the shell pot 105 adjacent the magnet 110 by, for example, by gluing to a voice coil former 116. In block 710, a cone 122 may be attached to the motor assembly 104. For further support, the cone 122 also may be attached to the speaker basket 102 along its outer periphery, while the cone 122 may be attached to the motor assembly 104, by glue or other attachment means. In addition, a core cap 130 may be attached to the motor assembly 104, as denoted by block 712.

By attaching the shell pot 105 to the speaker basket 102 through the mounting plate 106, a simple attachment interface can be defined that allows the use of multiple speaker motor designs with a single speaker basket 102 thereby reducing manufacturing complexity and cost of the speaker assembly.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A speaker assembly comprising: a speaker basket; a mounting plate attached to the speaker basket; a shell pot configured to receive a speaker motor, the shell pot being affixed to the mounting plate, thereby coupling the shell pot to the speaker basket and where the mounting plate includes bores and the speaker basket extends through the bores thereby engaging the mounting plate.

2. The speaker assembly according to claim 1, where the speaker basket comprises thermoplastic resin.

3. The speaker assembly according to claim 1, where the mounting plate is molded into the speaker basket.

4. The speaker assembly according to claim 1, where the mounting plate is embedded in the speaker basket.

5. The speaker assembly according to claim 1, where the bores are peripherally located about the mounting plate.

6. The speaker assembly according to claim 1, where the mounting plate comprises a metal mounting plate.

7. The speaker assembly according to claim 6, where the mounting plate further comprises a steel mounting plate with a zinc coating.

8. The speaker assembly according to claim 7, where the mounting plate has a thickness greater than about 1 mm.

9. The speaker assembly according to claim 1, where the mountain plate is formed to include an opening configured to receive the shell pot.

10. The speaker assembly according to claim 9, where the mounting plate comprises a mounting ring.

11. The speaker assembly according to claim 1, where the shell pot is staked to the mounting plate.

12. The speaker assembly according to claim 1, where the shell pot includes a first flange configured to interface with a first side of the mounting plate.

13. The speaker assembly according to claim 12, where the shell pot includes a second flange configured to interface with a second side of the mounting plate, where the second side is positioned opposite the first side.

14. The speaker assembly according to claim 13, where the second flange includes a lip that is staked against the mounting plate.

15. The speaker assembly according to claim 1, where the mounting plate includes a first portion and a second portion, and where the second portion extends from the first portion at an angle.

16. A speaker assembly comprising: a speaker motor; a shell pot configured to receive the speaker motor; a mounting plate having an opening configured to receive the shell pot, the shell pot being affixed to the mounting plate; and a plastic speaker basket formed about the mounting plate, and operable to couple the mounting plate to the plastic speaker basket and where the mounting plate comprises bores, and the plastic speaker basket extends through the bores to engage the mounting plate.

17. The speaker assembly according to claim 16, where the bores are peripherally located about the mounting plate.

18. The speaker assembly according to claim 16, where the mounting plate comprises a steel ring.

19. The speaker assembly according to claim 18, where the steel ring has a thickness greater than about 1 mm.

20. The speaker assembly according to claim 16, where the shell pot includes a first flange that engages a first side of the mounting plate and a second flange that engages a second side of the mounting plate, where the first and second sides of the mounting plate are opposite sides.

21. The speaker assembly according to claim 20, where the shell pot is staked to the mounting plate.

* * * * *